US009659709B2

(12) United States Patent
Chang et al.

(10) Patent No.: US 9,659,709 B2
(45) Date of Patent: May 23, 2017

(54) COMMON MODE FILTER AND MANUFACTURING METHOD THEREOF

(71) Applicant: SAMSUNG ELECTRO-MECHANICS CO., LTD., Suwon (KR)

(72) Inventors: Geon-Se Chang, Seoul (KR); Jeong-Min Cho, Seongnam (KR); Jin-Hyuck Yang, Suwon (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 5 days.

(21) Appl. No.: 14/615,039

(22) Filed: Feb. 5, 2015

(65) Prior Publication Data

US 2015/0325363 A1 Nov. 12, 2015

(30) Foreign Application Priority Data

May 8, 2014 (KR) ..... 10-2014-0055038

(51) Int. Cl.

| | |
|---|---|
| ***H01F 27/29*** | (2006.01) |
| ***H01F 41/04*** | (2006.01) |
| ***H01F 27/28*** | (2006.01) |
| ***H01F 17/00*** | (2006.01) |
| ***H01F 17/04*** | (2006.01) |
| ***H01F 27/255*** | (2006.01) |

(52) U.S. Cl.

CPC ..... *H01F 41/046* (2013.01); *H01F 17/0013* (2013.01); *H01F 17/04* (2013.01); *H01F 27/255* (2013.01); *H01F 27/2804* (2013.01); *H01F 27/29* (2013.01); *H01F 27/292* (2013.01); *H01F 41/041* (2013.01); *Y10T 29/49075* (2015.01)

(58) Field of Classification Search

CPC ..... H01F 27/00–27/30
USPC ..... 336/65, 83, 192, 200, 232
See application file for complete search history.

(56) References Cited

U.S. PATENT DOCUMENTS

2010/0157565 A1 6/2010 Yoshida et al.
2011/0291790 A1* 12/2011 Okumura ..... H01F 17/0013 336/200

(Continued)

FOREIGN PATENT DOCUMENTS

| | | | |
|---|---|---|---|
| JP | 2011-071457 | A | 4/2011 |
| JP | 2012-015493 | A | 1/2012 |
| KR | 10-2012-0033644 | A | 4/2012 |

OTHER PUBLICATIONS

Japanese Office Action issued in Application No. 2014-258362 dated Jan. 31, 2017, with English translation.

*Primary Examiner* — Tuyen Nguyen
(74) *Attorney, Agent, or Firm* — McDermott Will & Emery LLP

(57) ABSTRACT

A common mode filter and a manufacturing method thereof are disclosed. A common mode filter in accordance with an aspect of the present invention includes: a substrate: a filter layer disposed on the substrate and configured to remove a signal noise; an electrode column formed to be bent along a perimetric portion of the filter layer and electrically connected with the filter layer; an electrode pad formed to have a larger longitudinal cross-sectional area than the electrode column and integrally coupled on the electrode column; and a magnetic layer formed on a layer on which the electrode column and the electrode pad are formed.

10 Claims, 6 Drawing Sheets

(56) References Cited

U.S. PATENT DOCUMENTS

| | | | | |
|---|---|---|---|---|
| 2014/0002231 | A1* | 1/2014 | Lee | H01F 27/255 336/233 |
| 2014/0176279 | A1* | 6/2014 | Yang | H01F 5/04 336/192 |
| 2014/0240075 | A1* | 8/2014 | Yang | H01F 17/0013 336/221 |

* cited by examiner

COMMON MODE FILTER AND MANUFACTURING METHOD THEREOF

CROSS-REFERENCE TO RELATED APPLICATIONS

This application claims the benefit of Korean Patent Application No. 10-2014-0055038, filed with the Korean Intellectual Property Office on May 8, 2014, the disclosure of which is incorporated herein by reference in its entirety.

BACKGROUND

1. Technical Field

The present invention relates to a common mode filter and a method of manufacturing the common mode filter.

2. Background Art

With the recent technological advancement, a growing number of electronic devices, such as mobile phones, home electronic appliances, PCs, PDAs and LCDs, have been changed from analog systems to digital systems. Moreover, owing to the increased amount of processed data, the electronic devices are required to be faster.

As the electronic devices are digitized and become faster, the electronic devices can be increasingly sensitive to irritation from outside. That is, any small abnormal voltage or high-frequency noise brought into the internal circuitry of an electronic device from the outside can cause a damage to the circuitry or a signal distortion.

Sources of the abnormal voltage and noise that cause the circuitry damage or signal distortion of the electronic device include lightning, discharging of static electricity that has been charged in human body, switching voltage generated in the circuitry, power noise included in the electric source voltage, unnecessary electromagnetic signal or electromagnetic noise, etc.

In order to prevent the circuitry damage or signal distortion of the electronic device, a filter needs to be installed to prevent the abnormal voltage and high-frequency noise from being brought into the circuitry. Particularly, a common mode filter is often installed in, for example, a high-speed differential signal line in order to remove common mode noise.

The related art of the present invention is disclosed in Korea Patent Publication No. 10-2012-0033644 (laid open on Apr. 9, 2012).

SUMMARY

Some embodiments of the present invention provide a common mode filter and a manufacturing method thereof that can facilitate manufacturing of the common mode filter, by enhancing the rigidity of an electrode column and the adhesive strength with a magnetic layer.

An aspect of the present invention provides a common mode filter, which includes: a substrate: a filter layer disposed on the substrate and configured to remove a signal noise; an electrode column formed to be bent along a perimetric portion of the filter layer and electrically connected with the filter layer; an electrode pad formed to have a larger longitudinal cross-sectional area than the electrode column and integrally coupled on the electrode column; and a magnetic layer formed on a layer on which the electrode column and the electrode pad are formed.

The substrate and the filter layer can be formed in the shape of a rectangular plane, and the electrode column can be extended along edges from each vertex of the filter layer.

The filter layer can include a plurality of dielectric layers and a plurality of spiral conductors that are laminated.

The electrode column can be formed to avoid an interference with surfaces projected longitudinally from the spiral conductors.

The substrate can include a magnetic material.

The magnetic layer can be made of a compound containing a magnetic material.

Another aspect of the present invention provides a method of manufacturing a common mode filter that includes: forming a filter layer on a substrate; forming a dry film pattern on the filter layer, the dry film pattern having a bent shape removed along perimetric portions of the filter layer; forming an electrode column on the filter layer by use of the dry film pattern; removing the dry film pattern; forming a portion of a magnetic layer on a layer on which the electrode column is formed; forming an electrode pad having a larger longitudinal cross-sectional area than the electrode column and integrally coupled on the electrode column; and forming remaining portions of the magnetic layer on a layer on which the electrode pad is formed.

DETAILED DESCRIPTION

Figure 1:
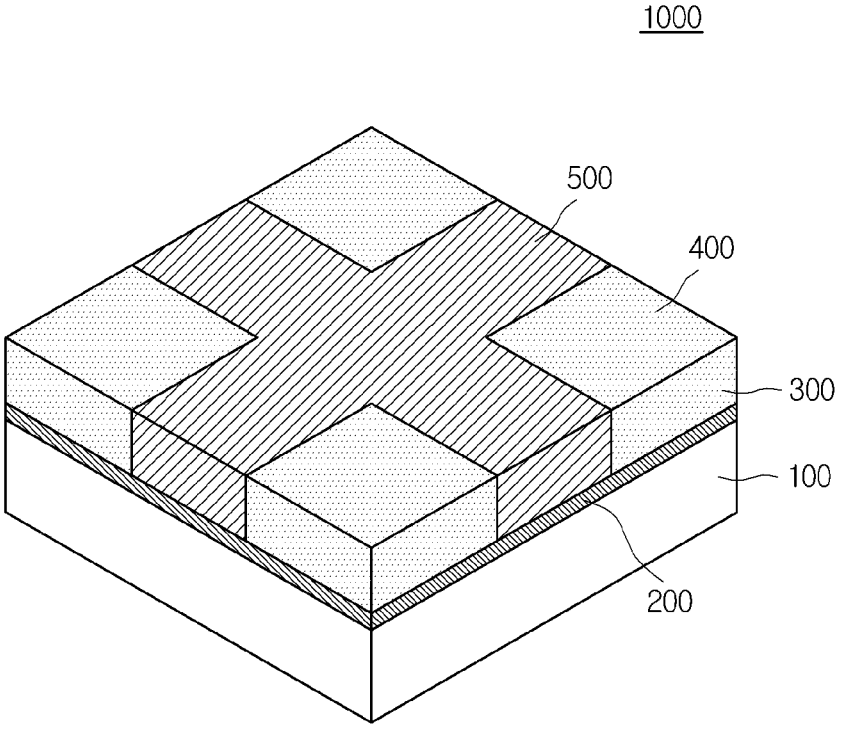
FIG. 1 is a brief illustration of a common mode filter in accordance with an embodiment of the present invention.

Hereinafter, certain embodiments of a common mode filter and a manufacturing method thereof in accordance with the present invention will be described in detail with reference to the accompanying drawings. In describing the present invention with reference to the accompanying drawings, any identical or corresponding elements will be assigned with same reference numerals, and no redundant description thereof will be provided.

Terms such as "first" and "second" can be used in merely distinguishing one element from other identical or corresponding elements, but the above elements shall not be restricted to the above terms.

When one element is described to be "coupled" to another element, it does not refer to a physical, direct contact between these elements only, but it shall also include the possibility of yet another element being interposed between these elements and each of these elements being in contact with said yet another element.

Figure 2:
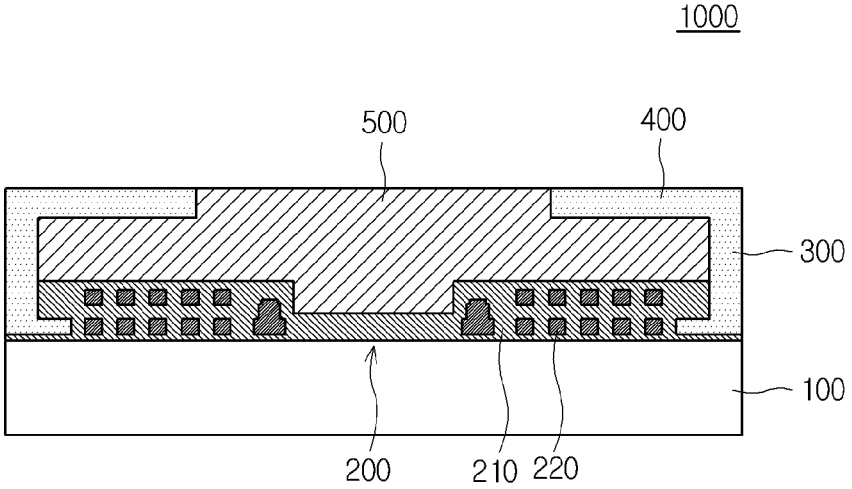
FIG. 2 is a longitudinal sectional view of the common mode filter in accordance with an embodiment of the present invention.
Figure 3:
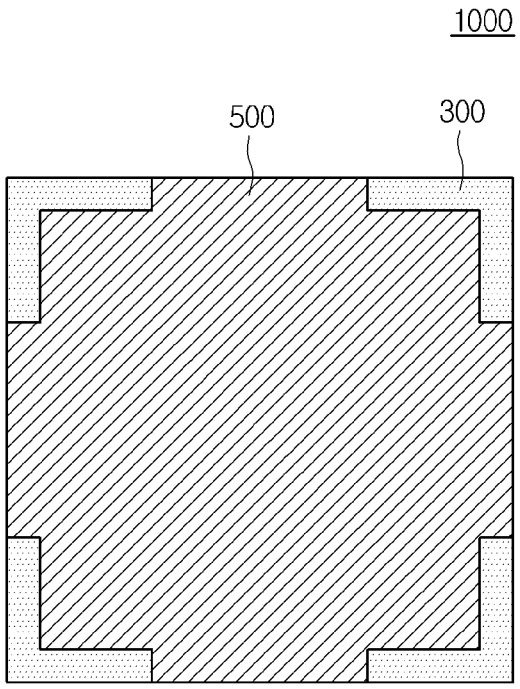
FIG. 3 is a transverse sectional view of the common mode filter in accordance with an embodiment of the present invention.

FIG. 1 is a brief illustration of a common mode filter in accordance with an embodiment of the present invention. FIG. 2 is a longitudinal sectional view of the common mode filter in accordance with an embodiment of the present invention. FIG. 3 is a transverse sectional view of the common mode filter in accordance with an embodiment of the present invention.

As illustrated in FIG. 1 to FIG. 3, a common mode filter 1000 in accordance with an embodiment of the present invention includes a substrate 100, a filter layer 200, an electrode column, an electrode pad 400 and a magnetic layer 500.

The substrate 100, which is a portion that supports the filter layer 200, can form a magnetic field with the magnetic layer 500. In such a case, the substrate 100 functions to support the filter layer 200 and can be disposed at a lower portion of the common mode filter 1000 in accordance with the present invention.

Here, the substrate 100 can include a magnetic material and function as a closed magnetic circuit. For instance, the substrate 100 can include sintered ferrite or a ceramic material such as forsterite. The substrate 100 can be formed with a predetermined area or thickness according to the shape of the common mode filter 1000.

The filter layer 200 is disposed on the substrate 100 to remove signal noises and can remove a signal noise through a spiral conductor 220 formed within a dielectric layer 210.

Here, the filter layer 200 can include a plurality of dielectric layers 210 and a plurality of spiral conductors 220 that are laminated. Specifically, the filter layer 200 can include the plurality of dielectric layers 210 that are successively laminated on an upper surface of the substrate 100 and the plurality of spiral conductors 220 that are interposed in between the dielectric layers 210.

In such a case, the spiral conductors 220 can be formed by plating a conductive layer by use of a seed layer deposited on the substrate 100 and patterning the conductive layer. Moreover, the spiral conductors 220 can be electrically connected with the electrode column 300 through a via or the like that penetrates the dielectric layers 210.

The electrode column 300, which is formed to be bent along a perimetric portion of the filter layer 200 and is electrically connected with the filter layer 200, can be electrically connected with an external electrode or external device while being coupled with the electrode pad 400. Here, the electrode column 300 can be electrically connected with the filter layer 200 through a via or the like which is formed at a portion of the filter layer 200.

As shown in FIG. 3, by being formed to be bent, the electrode column 300 can have a relatively small cross-sectional area and have a plurality of surfaces contacted with the magnetic layer 500. Moreover, the bent electrode column 300 can increase the rigidity against an external force in a transverse direction while having a relatively small cross-sectional area.

The electrode pad 400, which has a larger longitudinal cross-sectional area than the electrode column 300 and is integrally coupled on the electrode column 300, can be electrically connected with an external electrode or external device. Here, as shown in FIG. 2, the electrode pad 400 is formed to have a larger longitudinal cross-sectional area than the electrode column 300 to facilitate connection with an external electrode or external device.

The magnetic layer 500, which is formed by filling a space between the electrode columns 300 and a space between the electrode pads 400, can form a magnetic field with the substrate 100. Moreover, together with the substrate 100, the magnetic layer 500 can protect the filter layer 200. The magnetic field can constitute an installation surface or a base surface of the common mode filter 1000 in accordance with the present embodiment.

Here, the magnetic layer 500 can be made of a compound containing a magnetic material. For example, the magnetic layer 500 can be made of epoxy resin containing ferrite powder. The magnetic layer 500 can be formed to have a thickness that is equal to or smaller than that of the electrode column 300 and the electrode pad 400.

As such, the common mode filter 1000 in accordance with the present embodiment has the electrode column 300 bent along the perimetric portion of the filter layer 200, increasing the rigidity of the electrode column 300 and the adhesive strength with the magnetic layer 500, and thus the common mode filter 1000 in accordance with the present embodiment can be readily manufactured.

In the common mode filter 1000 in accordance with the present embodiment, the substrate 100 and the filter layer 200 can be formed in the shape of a rectangular plane, and the electrode column 300 can be extended along edges from each vertex. In other words, as shown in FIG. 3, the electrode column 300 can be formed in the shape of letter "L" at each vertex of the filter layer 200.

Accordingly, while the electrode column 300 is uniformly formed on every lateral surface of the common mode filter 1000 in accordance with the present embodiment, the rigidity of the electrode column 300 and the adhesive strength with the magnetic layer 500 can be enhanced.

Here, the electrode column 300 can be formed to avoid an interference with surfaces projected longitudinally from the spiral conductors 220. In other words, as shown in FIG. 2, the electrode column 300 can be disposed at the perimetric portion of the filter layer 200 so as to avoid areas above the spiral conductors 220.

A possible major cause of damaging a self-resonance frequency (SRF) in a common mode filter is parasitic capacitance, which is mostly measured between circuits carrying electricity and works to lower the impedance.

Especially, the parasitic capacitance is occurred mostly by an electrode placed above the spiral conductors 220, and thus the interference in the longitudinal direction between the electrode and the spiral conductors 220 need to be minimized in order to reduce the parasitic capacitance.

Therefore, in the common mode filter 1000 in accordance with the present embodiment, the electrode column 300 is formed to avoid the interference with surfaces projected longitudinally from the spiral conductors 220 to minimize the parasitic capacitance and improve the SRF.

As a result, the common mode filter 1000 can perform in a wider range of frequencies, and filtering can be more effective in a high-frequency area.

Figure 4:
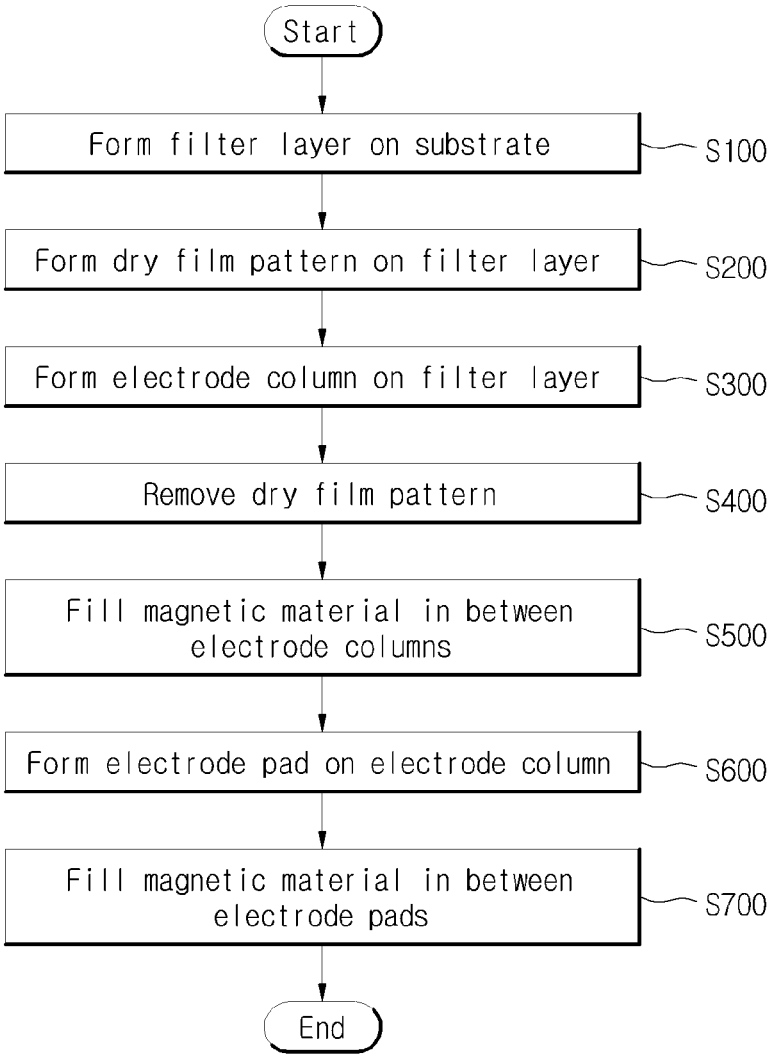
FIG. 4 is a flow diagram showing a method of manufacturing a common mode filter in accordance with an embodiment of the present invention.

FIG. 4 is a flow diagram showing a method of manufacturing a common mode filter in accordance with an embodiment of the present invention. FIG. 5, FIG. 6, FIG. 7, FIG. 8 and FIG. 9 show major steps of the method of manufacturing a common mode filter in accordance with an embodiment of the present invention.

Here, for the convenience of description, most main elements described in the method of manufacturing a common mode filter in accordance with an embodiment of the present invention shall be referred to FIG. 1 to FIG. 3.

As illustrated in FIG. 4 to FIG. 9, the method of manufacturing a common mode filter in accordance with an embodiment of the present invention starts with forming a filter layer 200 on a substrate 100 (S100).

Here, the filter layer 200 can include a plurality of dielectric layers 210 and a plurality of spiral conductors 220 that are laminated. Moreover, the spiral conductors 220 can be formed by plating a conductive layer by use of a seed layer deposited on the substrate 100 and patterning the conductive layer.

Figure 5:
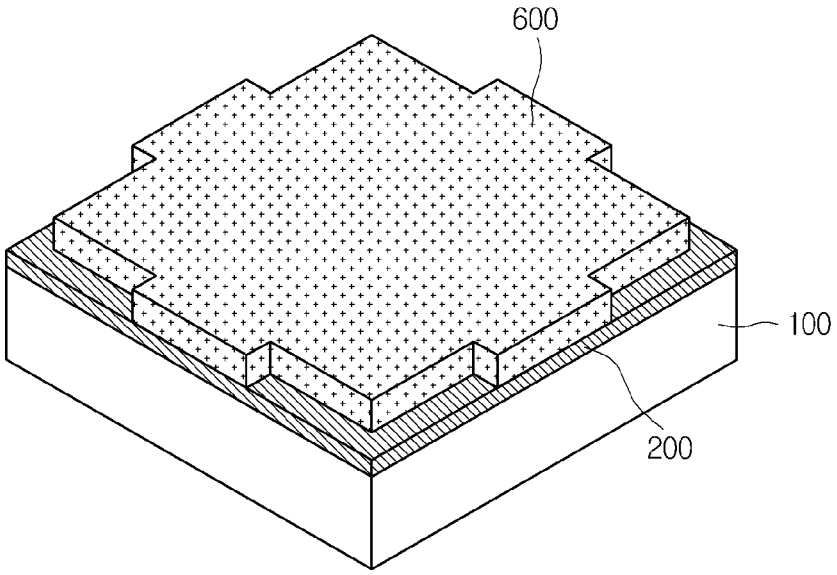
FIG. 5, FIG. 6, FIG. 7, FIG. 8 and FIG. 9 show major steps of the method of manufacturing a common mode filter in accordance with an embodiment of the present invention.

Then, a dry film pattern 600, with a bent shape removed along perimetric portions of the filter layer, can be formed on the filter layer 200 (S200, FIG. 5). Specifically, by processing, for example, a photolithography after attaching a dry film on the filter layer, the dry film pattern 600 can be formed having the dry film removed in the bent shape along the perimetric portions of the filter layer 200.

Figure 6:
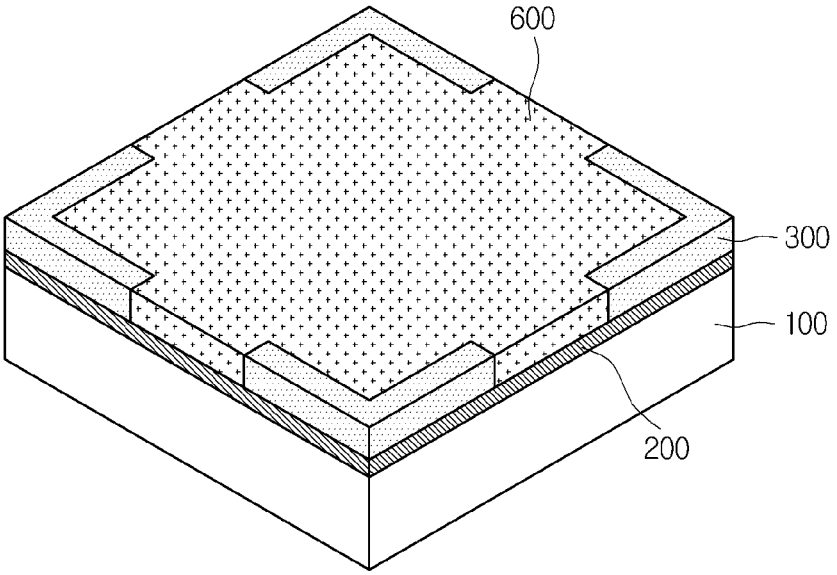

Next, an electrode column 300 can be formed on the filter layer 200 by use of the dry film pattern 600 (S300, FIG. 6). Specifically, by using the dry film pattern 600 as a mask, the electrode column 300 can be plated in the bent shape along the perimetric portions of the filter layer 200.

Here, by forming the electrode column 300 to avoid an interference with surfaces projected longitudinally from the spiral conductors 220, parasitic capacitance can be minimized, and an SRF can be improved.

Figure 7:
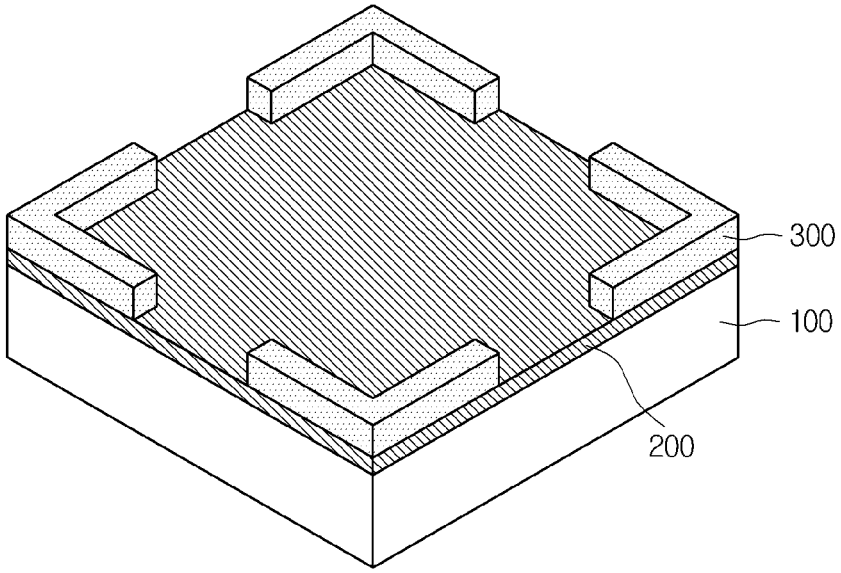

Next, the dry film pattern 600 can be removed (S400, FIG. 7). Specifically, the dry film disposed between the electrode columns 300 can be, for example, stripped off.

Figure 8:
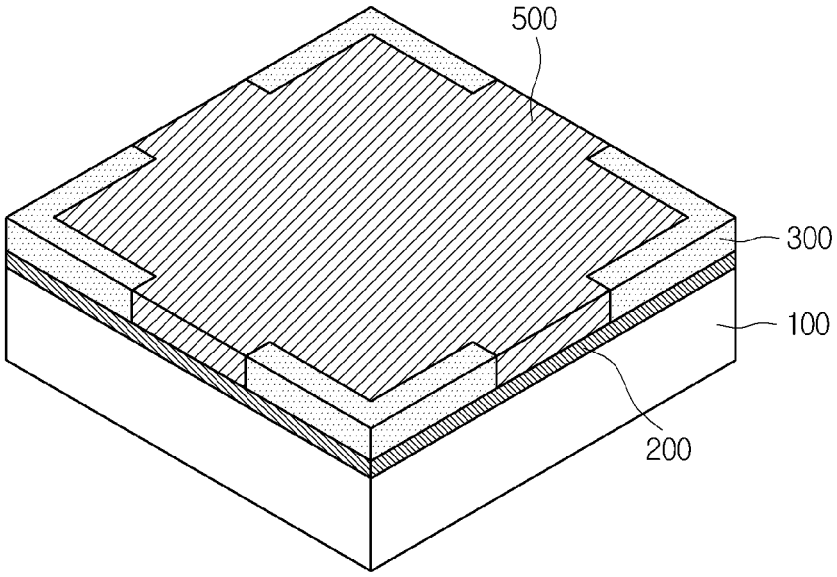

Thereafter, a portion of a magnetic layer 500 can be formed by filling a magnetic material in between the electrode columns 300 (S500, FIG. 8). Here, the portion of the magnetic layer 500 can be formed by coating a compound including, for example, epoxy resin containing ferrite powder in between the electrode columns 300.

Then, an electrode pad 400, having a larger longitudinal cross-sectional area than the electrode column 300 and being integrally coupled on the electrode column 300, can be formed (S600). That is, the electrode pad 400 having a larger longitudinal cross-sectional area than the electrode column 300 can be plated over the electrode column 300.

Figure 9:
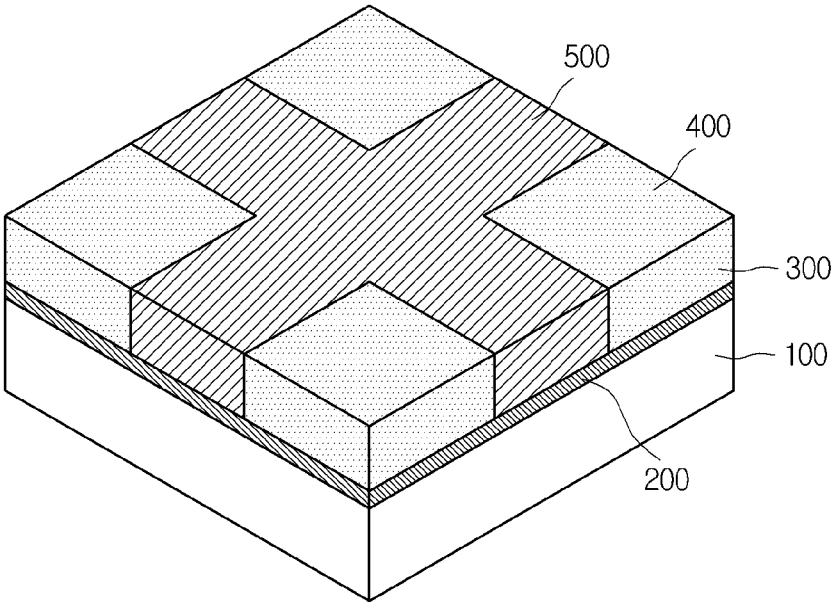

Afterwards, remaining portions of the magnetic layer 500 can be formed by filling a magnetic material in between the electrode pads 400 (S700, FIG. 9). Here, the remaining portions of the magnetic layer 500 can be formed by coating a compound including, for example, epoxy resin containing ferrite powder in between the electrode pads 400.

In other words, the portion of the magnetic layer 500 formed in step S500 and the remaining portions of the magnetic layer 500 formed in step S700 can be integrally formed to form a magnetic field and to constitute an installation surface or base surface of the common mode filter 1000.

As such, the method of manufacturing a common mode filter in accordance with the present embodiment has the electrode column 300 bent along the perimetric portions of the filter layer 200, increasing the rigidity of the electrode column 300 and the adhesive strength with the magnetic layer 500, and thus the common mode filter 1000 in accordance with the present embodiment can be readily manufactured.

Most elements and configurations of the method of manufacturing a common mode filter in accordance with an embodiment of the present invention are identical or similar to those of the common mode filter 1000 in accordance with an embodiment of the present invention, and thus any redundant description will not be provided herein.

Although certain embodiments of the present invention have been described, it shall be appreciated that there can be a very large number of permutations and modification of the present invention by those who are ordinarily skilled in the art to which the present invention pertains without departing from the technical ideas and scope of the present invention, which shall be defined by the claims appended below.

It shall be also appreciated that many other embodiments than the embodiments described above are included in the claims of the present invention.

What is claimed is:

1. A common mode filter comprising:

a substrate:

a filter layer disposed on the substrate and configured to remove a signal noise;

an electrode column formed to be bent along a perimetric portion of the filter layer and electrically connected with the filter layer;

an electrode pad formed to have a larger longitudinal cross-sectional area than the electrode column and integrally coupled on the electrode column; and a magnetic layer formed on a layer on which the electrode column and the electrode pad are formed.

2. The common mode filter of claim 1, wherein the substrate and the filter layer are formed in the shape of a rectangular plane, and wherein the electrode column is extended along edges from each vertex of the filter layer.

3. The common mode filter of claim 1, wherein the filter layer comprises a plurality of dielectric layers and a plurality of spiral conductors that are laminated.

4. The common mode filter of claim 3, wherein the electrode column is formed to avoid an interference with surfaces projected longitudinally from the spiral conductors.

5. The common mode filter of claim 1, wherein the substrate comprises a magnetic material.

6. The common mode filter of claim 1, wherein the magnetic layer is made of a compound containing a magnetic material.

7. The common mode filter of claim 2, wherein the filter layer comprises a plurality of dielectric layers and a plurality of spiral conductors that are laminated.

8. The common mode filter of claim 7, wherein the electrode column is formed to avoid an interference with surfaces projected longitudinally from the spiral conductors.

9. The common mode filter of claim 2, wherein the substrate comprises a magnetic material.

10. The common mode filter of claim 2, wherein the magnetic layer is made of a compound containing a magnetic material.

* * * * *